US005206911A

United States Patent [19]

Eriksson et al.

[11] Patent Number: 5,206,911

[45] Date of Patent: Apr. 27, 1993

[54] CORRELATED ACTIVE ATTENUATION SYSTEM WITH ERROR AND CORRECTION SIGNAL INPUT

[75] Inventors: Larry J. Eriksson, Madison; Mark C. Allie, Oregon, both of Wis.

[73] Assignee: Nelson Industries, Inc., Stoughton, Wis.

[21] Appl. No.: 835,721

[22] Filed: Feb. 11, 1992

[51] Int. Cl.[5] ..... G10K 11/16

[52] U.S. Cl. ..... 381/71

[58] Field of Search ..... 381/71, 94

[56] References Cited

U.S. PATENT DOCUMENTS

| | | | |
|---|---|---|---|
| 2,983,790 | 5/1961 | Olson . | |
| 4,677,676 | 6/1987 | Eriksson . | |
| 4,677,677 | 6/1987 | Eriksson . | |
| 4,987,598 | 1/1991 | Eriksson . | |
| 5,105,377 | 4/1992 | Ziegler, Jr. | 364/724.01 |

OTHER PUBLICATIONS

"Active Adaptive Sound Control in a Duct: A Computer Simulation", J. C. Burgess, Journal of Acoustic Society of America, 70(3), Sep. 1981, pp. 715-726.

"Number Theory in Science and Communications", M. R. Schroeder, Berlin, Springer-Berlag, 1984, pp. 252-261.

"Development of the Filter-U Algorithm for Active Noise Control", L. J. Eriksson, Journal of Acoustic Society of America, 89(1), Jan. 1991, pp. 257-265.

"Recursive Algorithms For Active Noise Control", International Symposium on Active Control of Sound and Vibration, Tokyo, Japan, Apr. 9-11, 1991, pp. 137-146.

*Primary Examiner*—Forester W. Isen

*Attorney, Agent, or Firm*—Andrus, Sceales, Starke & Sawall

[57] ABSTRACT

An active acoustic attenuation system attenuates a correlated input acoustic wave and eliminates the need for an input transducer sensing such wave. An output transducer introduces a canceling acoustic wave to attenuate the input acoustic wave and yield an attenuated output acoustic wave. An error transducer senses the output acoustic wave and provides an error signal. An adaptive filter model has a model input, a model output outputting a correction signal to the output transducer to introduce the canceling acoustic wave and an error input from the error transducer. A summer has a first input from the model output, a second input from the error transducer, and an output outputting a resultant sum to the model input, such that the model input is provided by the sum of the correction signal and the error signal.

4 Claims, 2 Drawing Sheets

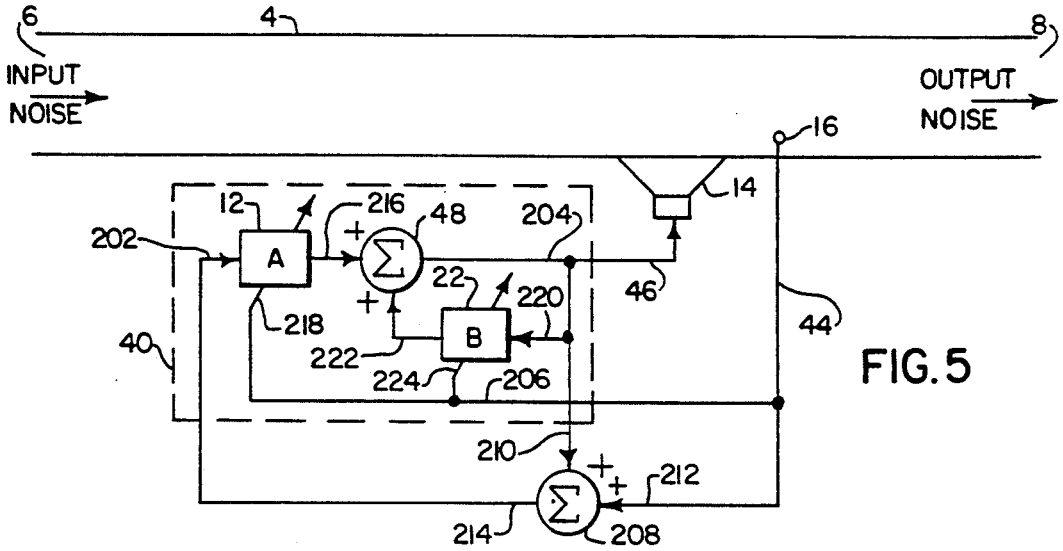
FIG. 5
FIG. 6
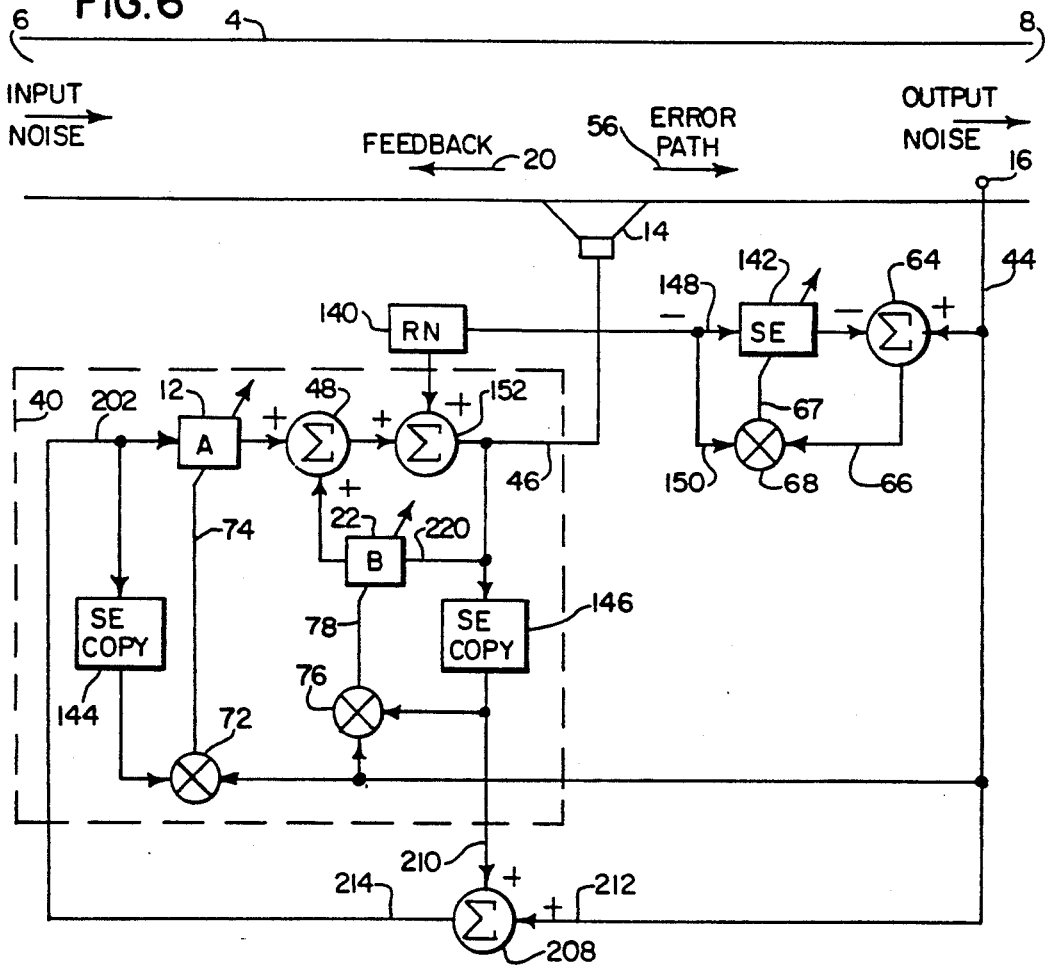

CORRELATED ACTIVE ATTENUATION SYSTEM WITH ERROR AND CORRECTION SIGNAL INPUT

BACKGROUND AND SUMMARY

The invention relates to active acoustic attenuation systems, and more particularly to a system for a correlated input acoustic wave, i.e. periodic, band-limited, or otherwise having some predictability.

The invention relates to the subject matter shown and described in commonly owned co-pending application Ser. No. 07/794,115, filed Nov. 15, 1991, and U.S. Pat. Nos. 4,677,676 and 4,677,677, incorporated herein by reference.

Active acoustic attenuation involves injecting a canceling acoustic wave to destructively interfere with and cancel an input acoustic wave. In an active acoustic attenuation system, the output acoustic wave is sensed with an error transducer, such as a microphone or an accelerometer, which supplies an error signal to an adaptive filter control model which in turn supplies a correction signal to a canceling output transducer, such as a loudspeaker or a shaker, which injects an acoustic wave to destructively interfere with the input acoustic wave and cancel same such that the output acoustic wave at the error transducer is zero or some other desired value.

The present invention provides an active acoustic attenuation system for attenuating correlated acoustic fields, including sound and vibration, and eliminates the need for an input transducer, such as an input microphone or an accelerometer sensing the input acoustic wave. Instead, the acoustic wave need only be sensed by the error transducer. The system has numerous applications, including attenuation of audible sound, and vibration control in structures or machines.

BRIEF DESCRIPTION OF THE DRAWINGS

Prior Art

Present Invention

Figure 4:
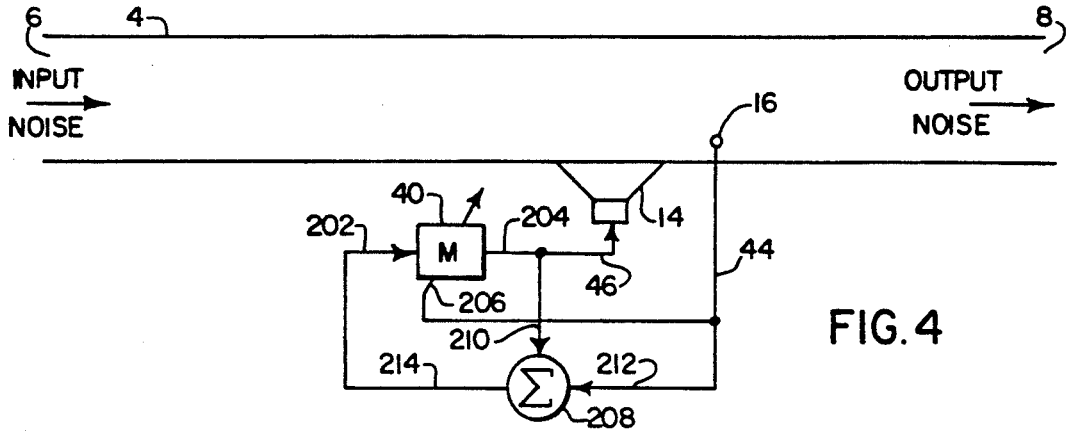

FIG. 4 is a schematic illustration of an active acoustic attenuation system in accordance with the present invention.

FIG. 5 shows another embodiment of the invention.

FIG. 6 shows a further embodiment of the invention.

DETAILED DESCRIPTION

Prior Art

Figure 1:
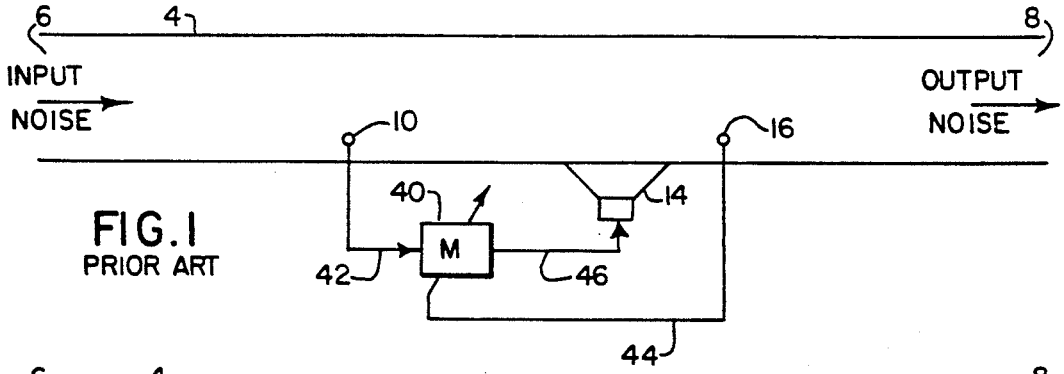
FIG. 1 PRIOR ART
FIG. 1 is a schematic illustration of an active acoustic attenuation system in accordance with above incorporated U.S. Pat. Nos. 4,677,676 and 4,677,677.

FIG. 1 shows an active acoustic attenuation system in accordance with incorporated U.S. Pat. Nos. 4,677,676 and 4,677,677 at FIG. 5, and like reference numerals are used from said patents where appropriate to facilitate understanding. For further background, reference is also made to "Development of the Filter-U Algorithm for Active Noise Control", L. J. Eriksson, Journal of Acoustic Society of America, 89(1), January, 1991, pages 257–265. The system includes a propagation path or environment such as within or defined by a duct or plant 4. The system has an input 6 for receiving an input acoustic wave, e.g. input noise, and an output 8 for radiating or outputting an output acoustic wave, e.g. output noise. An input transducer such as input microphone 10 senses the input acoustic wave. An output transducer such as canceling loudspeaker 14 introduces a canceling acoustic wave to attenuate the input acoustic wave and yield an attenuated output acoustic wave. An error transducer such as error microphone 16 senses the output acoustic wave and provides an error signal at 44. Adaptive filter model M at 40 adaptively models the acoustic path from input transducer 10 to output transducer 14. Model M has a model input 42 from input transducer 10, an error input 44 from error transducer 16, and a model output 46 outputting a correction signal to output transducer 14 to introduce the canceling acoustic wave.

As noted in incorporated U.S. Pat. Nos. 4,677,676 and 4,677,677, model M is an adaptive recursive filter having a transfer function with both poles and zeros. Model M is provided by a recursive least mean square, RLMS, filter having a first algorithm filter provided by least mean square, LMS, filter A at 12, FIG. 2, and a second algorithm filter provided by LMS filter B at 22. Adaptive model M uses filters A and B to adaptively model both the acoustic path from input transducer 10 to output transducer 14 and the feedback path from output transducer 14 to input transducer 10. Filter A provides the direct transfer function, and filter B provides a recursive transfer function. The outputs of filters A and B are summed at summer 48, whose output provides the correction signal on line 46.

Figure 3:
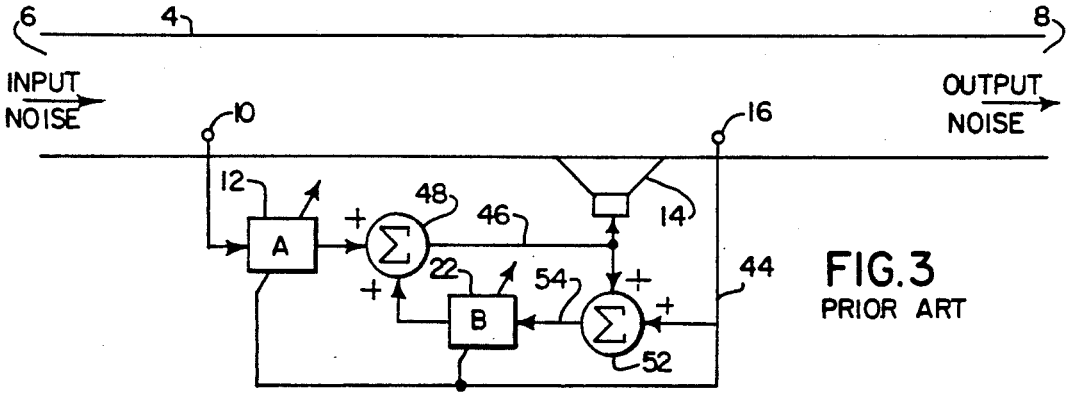
FIG. 3 PRIOR ART
FIG. 3 shows a further embodiment of the system in accordance with the noted incorporated patents.

As noted in incorporated U.S. Pat. No. 4,677,677, column 7, lines 30+, it is desirable to use the noise in the duct immediately upstream of speaker 14 as the input to filter B. This is because the correction signal at 46 tends to become equal to such noise as the model adapts and converges. By using the noise in the duct as the input to filter B instead of correction signal 46, the proper input to filter B is provided immediately, rather than waiting for convergence of the model. Thus, improved performance is possible from the beginning of operation. However, it is difficult to measure the noise without the interaction of the canceling sound from speaker 14. FIG. 9 of incorporated U.S. Pat. No. 4,677,677 shows a desirable implementation enabling the desired modeling without the noted measurement problem, which implementation is also illustrated in FIG. 3 herein. In FIG. 3, the error signal at 44 is summed at summer 52 with the correction signal at 46, and the result is provided as the filter input 54 to filter B. Input 54 is equal to the noise in the duct at 50 in FIG. 8 of incorporated U.S. Pat. No. 4,677,677, however it has been obtained without the impractical acoustical measurement required in FIG. 8 of the '677 patent. The noise in the duct approaching speaker 14 is subtractively summed (summer 18 in FIGS. 8 and 9 of the '677 patent) with correction signal 46 and is sensed by microphone 16 to yield correction signal 44 which is then additively summed with correction signal 46 at summer 52, to yield at output 54 the noted noise in the duct. The implementation shown in FIG. 3 herein and in FIGS. 9 and 11 of the '677 patent is called the equation error form, and is also described and shown in FIG. 4 of my article entitled "Recursive Algorithms for Active Noise Control", International Symposium on Active Control of Sound and Vibration, Tokyo, Japan, Apr. 9-11, 1991, pages 137-146.

As noted in the '676 and '677 patents, no input microphone is necessary, and instead the input signal may be provided by a transducer such as a tachometer which provides the frequency of a periodic input acoustic wave. Further alternatively, the input signal may be provided by one or more error signals, in the case of a periodic noise source, "Active Adaptive Sound Control in a Duct: A Computer Simulation", J. C. Burgess, Journal of Acoustic Society of America, 70(3), September, 1981, pages 715-726. Feedback control with a single microphone is also known in the art, U.S. Pat. No. 2,983,790.

Present Invention

Figure 2:
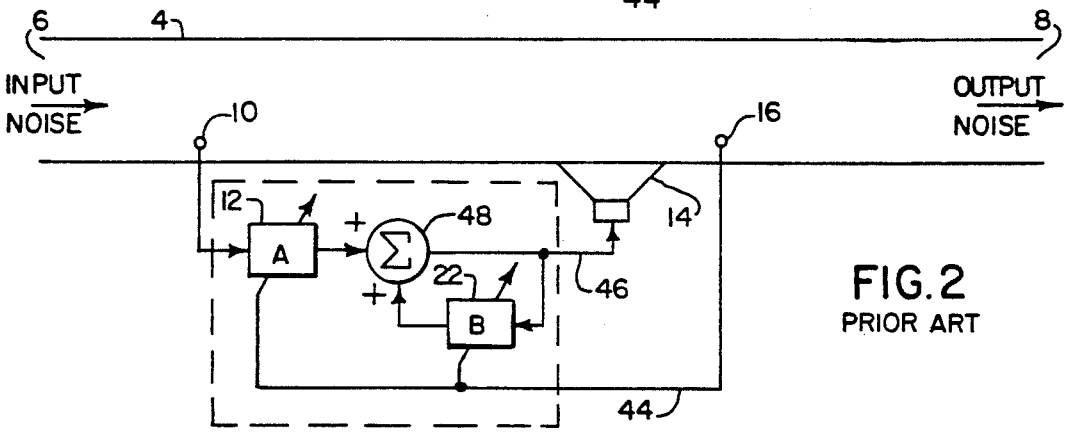
FIG. 2 PRIOR ART
FIG. 2 shows another embodiment of the system of FIG. 1.

FIG. 4 shows an active acoustic attenuation system in accordance with the invention, and uses like reference numerals from FIGS. 1-3 where appropriate to facilitate understanding. The system attenuates a correlated input acoustic wave without the need for an input transducer such as 10 in FIGS. 1-3. Correlated means periodic, band-limited, or otherwise having some predictability. Output transducer 14 introduces a canceling acoustic wave to attenuate the input acoustic wave and yield an attenuated output acoustic wave. Error transducer 16 senses the output acoustic wave and provides an error signal at 44. Adaptive filter model M at 40 has a model input at 202, a model output 204 outputting the correction signal at 46 to output transducer 14, and an error input 206 receiving the error signal at 44 from error transducer 16. Summer 208 has a first input 210 receiving correction signal 46 from model output 204, a second input 212 receiving error signal 44 from error transducer 16, and an output 214 outputting a resultant sum to model input 202, such that the model input is provided by the sum of the correction and error signals 46 and 44. Model M may be a FIR, finite impulse response, filter such as an LMS, least mean square, algorithm filter, or an IIR, infinite impulse response, filter, such as a RLMS, recursive least mean square, algorithm filter, as in the incorporated '676 and '677 patents. The system is described and shown in FIG. 5 of my article entitled "Recursive Algorithms For Active Noise Control", International Symposium on Active Control of Sound and Vibration, Tokyo, Japan, Apr. 9-11, 1991, pages 137-146.

FIG. 5 shows recursive model structure, and uses like reference numerals from FIGS. 1-4. Algorithm filter A at 12 has a filter input 202 from summer 208, a filter output 216, and an error input 218 receiving error signal 44 from error transducer 16. Algorithm filter B at 22 has a filter input 220 from correction signal 46, a filter output 222, and an error input 224 receiving error signal 44 from error transducer 16. Summer 48 has a first input from filter output 216, a second input from filter output 222, and an output 204 outputting a resultant sum as correction signal 46 to output transducer 14. It is preferred that each filter A and B be a least mean square algorithm filter, to thus provide a recursive least mean square filter model.

It is preferred that the model include a speaker and error path model modeling output transducer 14 and the error path between output transducer 14 and error transducer 16 as in FIGS. 19 and 20 of the incorporated '676 patent. FIG. 6 herein uses like reference numerals from FIGS. 19 and 20 of the incorporated '676 patent where appropriate to facilitate understanding. The error source 140 with a copy of the respective error path model provided at 144, 146, as in the incorporated '676 patent. Alternatively, the speaker and/or error path may be modeled without a random noise source as in U.S. Pat. No. 4,987,598, incorporated herein by reference. It is preferred that the error path modeling include modeling of both the transfer function of speaker 14 and the acoustic path from such speaker to error microphone 16, though the SE model may include only one of such transfer functions, for example if the other transfer function is relatively constant, or may include other transfer functions after model M.

Auxiliary noise source 140 introduces noise into the output of model 40. The auxiliary noise source is random and uncorrelated to the input noise at 6, and in preferred form is provided by a Galois sequence, M. R. Schroeder, "Number Theory in Science and Communications", Berlin, Springer-Berlag, 1984, pages 252-261, though other random uncorrelated noise sources may of course be used. The Galois sequence is a pseudo random sequence that repeats after $2^M-1$ points, where M is the number of stages in a shift register. The Galois sequence is preferred because it is easy to calculate and can easily have a period much longer than the response time of the system. Model 142 models both the error path E at 56 and the speaker or output transducer S at 14 on-line. Model 142 is an adaptive filter model provided by an LMS filter. A copy of the SE model is provided at 144 and 146 in model 40 to compensate for speaker 14 and error path 56. Adaptive filter model 142 has a model input 148 from auxiliary noise source 140. The error signal output 44 of error path 56 at output microphone 16 is summed at summer 64 with the output of model 142 and the result is used as an error input to model 142. The sum at 66 is multiplied at multiplier 68 with the auxiliary noise at 150 from auxiliary noise source 140, and the result is used as a weight update signal at 67 to model 142. The outputs of the auxiliary noise source 140 and model 40 are summed at summer 152 and the result is used as the correction signal at 46 to output transducer 14. Adaptive filter model 40, as noted above, is provided by first and second algorithm filters A and B at 12 and 22 each having an error input from error microphone 16. The outputs of algorithm filters A and B are summed at summer 48 and the resulting sum is summed at summer 152 with the auxiliary noise from auxiliary noise source 140 and the resulting sum is used as the correction signal at 46 to output transducer 14. Filter A input 202 also provides an input to SE model copy 144, whose output is multiplied at multiplier 72 with the error signal 44 and the result is provided as weight update signal 74 to filter A. The correction signal 46 provides filter input 220 to filter B and also provides an input to SE model copy 146, whose output is multiplied at multiplier 76 with error signal 44 and the result is provided as weight update signal 78 to filter B. The output of SE model copy 146 is also provided to summer 208 at input 210.

It is recognized that various equivalents, alternatives and modifications are possible within the scope of the appended claims.

We claim:

1. An active acoustic attenuation system for attenuating a correlated input acoustic wave and eliminating the need for an input transducer sensing said input acoustic wave, comprising:

an output transducer introducing a canceling acoustic wave to attenuate said input acoustic wave and yield an attenuated output acoustic wave;

an error transducer sensing said output acoustic wave and providing an error signal;

an adaptive filter model having a model input, a model output outputting a correction signal to said output transducer to introduce said canceling acoustic wave, and an error input from said error transducer;

a first summer having a first input from said model output, a second input from said error transducer, and an output outputting a resultant sum to said model input, such that said model input is provided by the sum of said correction signal and said error signal;

an auxiliary noise source introducing auxiliary noise into said adaptive filter model;

a second adaptive filter model adaptively modeling at least one of said output transducer and an error path between said output transducer and said error transducer;

a copy of said second adaptive filter model in said first adaptive filter model to compensate for said one of said output transducer and said error path;

wherein said second adaptive filter model has a model input from said auxiliary noise source, and said copy of said second adaptive filter model has an output provided to said first summer for summing with said error signal;

wherein said first mentioned adaptive filter model comprises:

an A filter having a filter input from said first summer, a filter output, and an error input from said error transducer;

a B filter having a filter input from said correction signal, a filter output, and an error input from said error transducer; and a second summer having a first input from said filter output of said A filter, a second input from said filter output of said B filter, and an output outputting a resultant sum as said correction signal;

and comprising:

a first copy of said second adaptive filter model compensating said one of said output transducer and said error path in said A filter;

a second copy of said second adaptive filter model compensating said one of said output transducer and said error path in said B filter, wherein said second copy of said second adaptive filter model has an output providing said first input to said first summer.

2. The invention according to claim 1 wherein said A filter has an input from said output of said first summer, said first copy of said second adaptive filter model has an input from said output of said first summer, and comprising a first multiplier multiplying the output of said first copy with said error signal and using the result as a weight update signal to said A filter, and wherein said B filter has an input from said correction signal, said second copy of said second adaptive filter model has an input form said correction signal, and comprising a second multiplier multiplying the output of said second copy with said error signal and using the result as a weight update signal to said B filter, and wherein said output of said second copy is summed at said first summer with said error signal and the resultant sum is provided as said input to said A filter.

3. An active acoustic attenuation method for attenuating a correlated input acoustic wave and eliminating the need for an input transducer sensing said input acoustic wave, comprising:

introducing a canceling acoustic wave from an output transducer to attenuate said input acoustic wave and yield an attenuated output acoustic wave;

sensing said output acoustic wave with an error transducer and providing an error signal;

providing an adaptive filter model, providing said model with a model input, providing said model with a model output outputting a correction signal to said output transducer to introduce said canceling acoustic wave, and providing said model with an error input from said error transducer;

summing said correction signal and said error signal and providing the resultant sum to said model input;

introducing auxiliary noise from an auxiliary noise source into said adaptive filter model;

providing a second adaptive filter model adaptively modeling at least one of said output transducer and an error path between said output transducer and said error transducer;

compensating for said one of said output transducer and said error path by providing a copy of said second adaptive filter model in said first adaptive filter model;

providing said second adaptive filter model with a model input from said auxiliary noise source, and summing the output of said copy of said second adaptive filter model with said error signal and providing the output resultant sum to said input of said first adaptive filter model.

4. An active acoustic attenuation system for attenuating an input acoustic wave comprising:

an output transducer introducing a canceling acoustic wave to attenuate said input acoustic wave and yield an attenuated output acoustic wave;

an error transducer sensing said output acoustic wave and providing an error signal;

a first adaptive filter model modeling said acoustic system and outputting a correction signal to said output transducer to introduce the canceling acoustic wave, said first adaptive filter model comprising:

a first algorithm filter comprising an A filter having a filter input, a filter output, and an error input from said error transducer;

a second algorithm filter comprising a B filter having a filter input from said correction signal, a filter output, and an error input from said error transducer; and a first summer having a first input from said filter output of said A filter, a second input from said filter output of said B filter, and an output outputting a resultant sum as said correction signal;

a second model modeling said output transducer and the error path between said output transducer and said error transducer;

a first model copy comprising a copy of said second model, and having an input, and having an output supplied to said error input of said A filter;

a second model copy comprising a copy of said second model, and having an input from said correction signal, and having an output supplied to said error input of said B filter;

a second summer having a first input from said error signal, and a second input from said output of said second model copy, and having an output supplying the resultant sum to said filter input of said A filter and to said input of said first model copy.

* * * * *